US008317551B2

(12) United States Patent
Aboulkassem et al.

(10) Patent No.: US 8,317,551 B2
(45) Date of Patent: Nov. 27, 2012

(54) CONTACT ARRANGEMENT FOR CONNECTION WITH A POLYGONAL SOCKET

(75) Inventors: Mohamed Aboulkassem, Darmstadt (DE); Bert Bergner, Bensheim (DE); Rudolf Kraemer, Lautertal (DE); Luis Javier Puras Trueba, Mannheim (DE); Thomas Scharf, Bensheim (DE); Christian Schrettlinger, Bensheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/087,849

(22) Filed: Apr. 15, 2011

(65) Prior Publication Data

US 2011/0195617 A1 Aug. 11, 2011

Related U.S. Application Data

(63) Continuation of application No. PCT/EP2009/066756, filed on Dec. 9, 2009.

(30) Foreign Application Priority Data

Dec. 19, 2008 (DE) ..... 10 2008 064 590

(51) Int. Cl.
*H01R 13/05* (2006.01)

(52) U.S. Cl. ..... 439/825

(58) Field of Classification Search ..... 439/825, 439/751, 82, 783, 786, 188, 637
See application file for complete search history.

(56) References Cited

U.S. PATENT DOCUMENTS 2,294,608 A 9/1940 Rudolphsen
4,362,353 A 12/1982 Cobaugh et al.
5,252,097 A * 10/1993 Lindeberg et al. ..... 439/856
5,533,915 A * 7/1996 Deans ..... 439/678
5,605,464 A * 2/1997 Ikesugi et al. ..... 439/70
6,988,913 B2 * 1/2006 Zhang ..... 439/637
7,048,594 B2 * 5/2006 Tsuchiya ..... 439/751

(Continued)

FOREIGN PATENT DOCUMENTS

BE 886321 A2 3/1981

(Continued)

OTHER PUBLICATIONS

German Office Action dated Aug. 6, 2009, cited in DE Application No. 102008064590.7, 3 pages.

(Continued)

*Primary Examiner* — Jean F Duverne
(74) *Attorney, Agent, or Firm* — Barley Snyder

(57) ABSTRACT

The invention relates to an electrical contact arrangement for high pulsed currents and for connection with a polygonal socket. The electrical contact arrangement includes first contact, arm, a second contact arm, an intermediate space provided between the first and second contact arms, and a third contact arm. The second contact arm positioned apart from the first contact arm in a deflection direction extending perpendicularly to the plug-in direction. The first contact arm and second contact arm extend substantially in a plug-in direction, and one of the first contact arm or second contact arm resiliently deflectable relative to the other contact arm in the deflection direction. The third contact arm extends in the plug-in direction and is positioned apart from the first contact arm and the second contact arm in a transverse direction extending perpendicularly to the plug-in and deflection directions. The third contact arm movable in the deflection direction and into the intermediate space.

21 Claims, 8 Drawing Sheets

U.S. PATENT DOCUMENTS

| | | | | |
|---|---|---|---|---|
| 7,249,981 | B2 * | 7/2007 | Chen | 439/751 |
| 7,377,823 | B2 * | 5/2008 | Chen | 439/751 |
| 2002/0031941 | A1 | 3/2002 | Cote et al. | |
| 2006/0035535 | A1 * | 2/2006 | Kawahara et al. | 439/751 |

FOREIGN PATENT DOCUMENTS

| | | | |
|---|---|---|---|
| DE | 1615760 | | 3/1972 |
| DE | 3540571 | A1 | 5/1987 |
| DE | 10129053 | A1 | 3/2002 |
| EP | 0105044 | A1 | 4/1984 |
| GB | 1203775 | | 9/1970 |
| GB | 2363526 | A | 12/2001 |
| WO | 8607201 | | 12/1986 |
| WO | 88/07201 | | 9/1988 |
| WO | 2006/126624 | A1 | 11/2006 |

OTHER PUBLICATIONS

PCT Search Report dated Mar. 2, 2010, cited in PCT Application No. PCT/EP2009/066756, 6 pages.

PCT Written Opinion dated Mar. 2, 2010, cited in PCT Application No. PCT/EP2009/066756, 6 pages.

* cited by examiner

CONTACT ARRANGEMENT FOR CONNECTION WITH A POLYGONAL SOCKET

CROSS-REFERENCE TO RELATED APPLICATIONS

This application is a continuation of PCT International Application No. PCT/EP2009/066756 filed Dec. 9, 2009, which claims priority under 35 U.S.C. §119 to German Patent Application No. 102008064590.7, filed Dec. 19, 2008.

FIELD OF THE INVENTION

The invention relates to an electrical contact arrangement and in particular to an electrical contact arrangement management for high pulsed currents and having two contact arms being at least in part positioned spaced from one another in a direction of deflection.

BACKGROUND

Electrical contact arrangements which withstand pulsed currents and are designed for connection with a polygonal socket are generally well-known. U.S. Pat. No. 5,533,915, for example, discloses a plug connector with two contact arrangements extending in the plug-in direction, the contact arrangements being formed of a cuboid contact pin and a flexible tongue. The flexible tongue is attached to one side of the contact pin, and bends in its arcuate course firstly away from the contact pin, in order subsequently to bend back towards the contact pin. Known flexible tongues are generally made from a resiliently readily deformable steel, for example a spring steel, and has a cross-section which permits sufficiently strong spring force.

On an opposite side from the flexible tongue, the contact pin includes a contact surface for electrical connection with a mating contact, into the socket of which the contact arrangement may be inserted in the plug-in direction.

A contact arrangement configured in this way has the advantage that the mating contact may be of simple construction and in particular does not require a flexible tongue to press down the contact pin, since this is provided by the contact arrangement. The contact arrangement is compactly configured, despite the flexible tongue. The mating contact may be shaped for example as a busbar, in which a polygonal and in particular rectangular socket has been punched. A socket body may be dispensed with, since the socket does not include any further parts; the socket configuration cannot be simplified any further.

Without external forces acting on the contact arrangement, the contact pin inserted into the socket rests against a connection side of the socket and there forms the electrically conductive part of the plug-and-socket connection. The flexible tongue rests against a side wall of the socket and presses the contact pin against the opposing, connection side of the socket. However, the flexible tongue contributes only insignificantly to current conduction, since, compared to the contact pin, it includes a smaller cross-section and a lower specific electrical conductivity than the contact pin, which is made as a rule from a metal with good electrical conductivity.

However, if a mechanical force acts on the contact arrangement, this force may lead to tilting or twisting of the contact pin, in particular around the plug-in direction. This creates risk of the contact pin becoming detached from the mating contact and the plug-and-socket connection between contact arrangement and mating contact being indeterminate. The conductivity of the plug-and-socket connection may diminish drastically.

The forces possibly twisting the plug connector may be caused, for example, by cables hanging from the contact arrangement. Even if no external mechanical forces act on the contact arrangement, the contact pin may tilt if the plug-and-socket connection is arranged in a possibly weak external magnetic field and a pulsed current of a few thousand amperes flows through the contact arrangement at least for a short time, i.e. for example for a period of a few milliseconds. Such pulsed currents may, for example, occur in the region of power electronics circuits in the event of switching processes and generate Lorentz forces, by means of which the contact arrangement may be twisted in the socket.

An indeterminate plug-and-socket connection possibly deteriorating in the event of high currents may lead to operating malfunctions of the power electronics and possibly cause arcing between the contact pin and the mating contact, by which the two contacts may be welded together virtually inseparably. The service life of the contact arrangement or of the mating contact may also be severely reduced by arcing which may arise and by erosion of the contact faces brought about thereby.

SUMMARY

It is therefore an object of the invention to provide an electric contact arrangement which ensures a reliable plug-and-socket connection in the event of high pulsed currents even with a simply configured polygonal socket.

The electrical contact arrangement includes first contact, arm, a second contact arm, an intermediate space provided between the first and second contact arms, and a third contact arm. The second contact arm positioned apart from the first contact arm in a deflection direction extending perpendicularly to the plug-in direction. The first contact arm and second contact arm extend substantially in a plug-in direction, and one of the first contact arm or second contact arm resiliently deflectable relative to the other contact arm in the deflection direction. The third contact arm extends in the plug-in direction and is positioned apart from the first contact arm and the second contact arm in a transverse direction extending perpendicularly to the plug-in and deflection directions. The third contact arm movable in the deflection direction and into the intermediate space.

BRIEF DESCRIPTION OF THE DRAWINGS

The invention is explained below by way of example by means of embodiments and with reference to the drawings. The various features of the embodiments may be combined mutually independently, as has already been explained with reference to the individual advantageous configurations.

In the drawings.

DETAILED DESCRIPTION OF THE EMBODIMENT(S)

Figure 1:
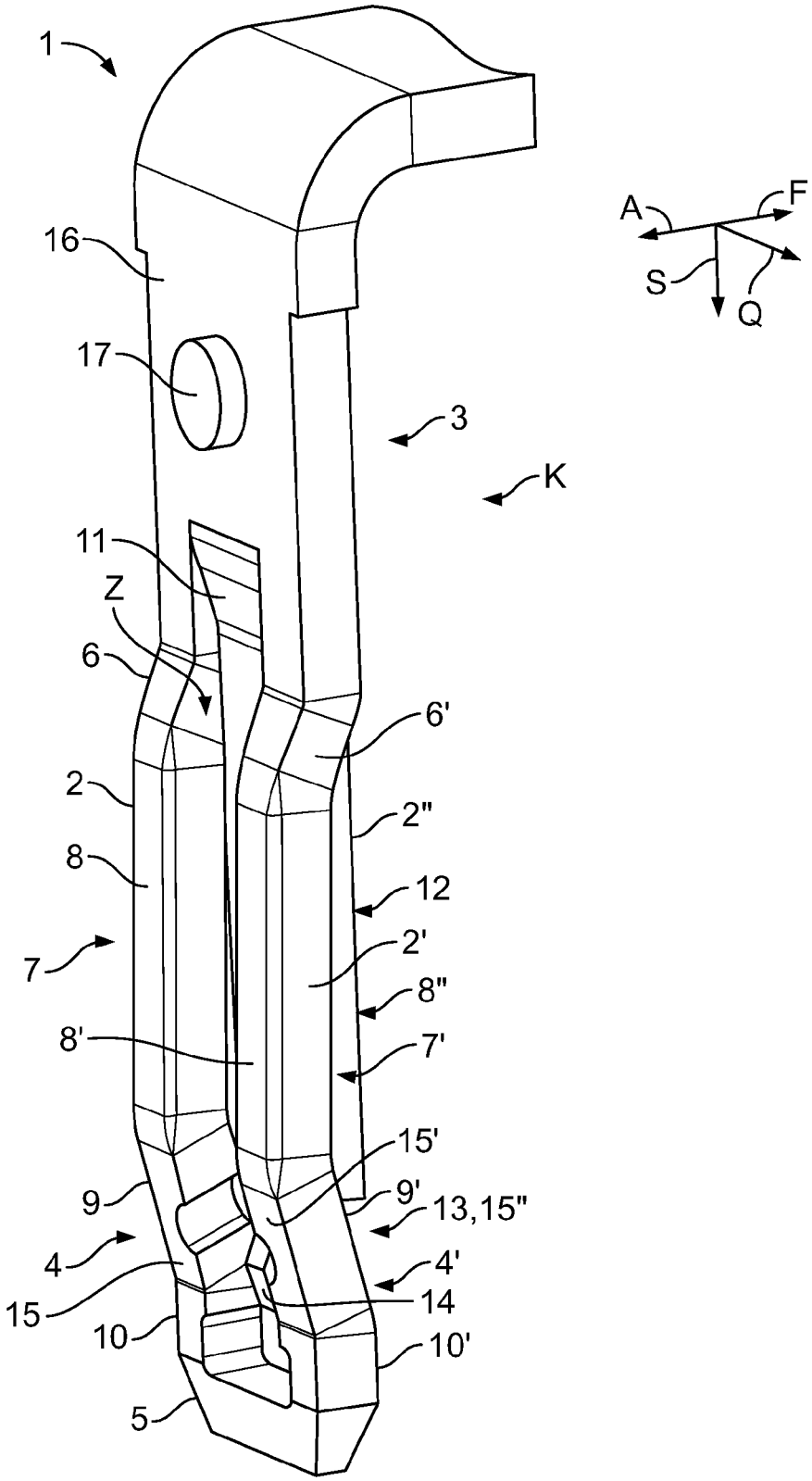
FIG. 1 is a perspective view of contact element of a contact arrangement according to the invention.

First of all, the structure and function of a contact arrangement K according to the invention will be described with reference to the exemplary embodiment of FIG. 1. A contact element 1 with three contact arms 2, 2', 2" extending in a plug-in direction S is shown. Contrary to the plug-in direction S, the contact arms 2, 2', 2" are shown connected to a contact arm holder 3 and may in particular be formed in one piece with the contact arm holder 3. Alternatively, the contact arms 2, 2', 2" may also be fastened differently to the contact arm holder 3 in an electrically conductive manner. Both the contact arm holder 3 and the contact arms 2, 2', 2" are made from an electrically conductive material and in particular from a metal and are possibly coated with another metal. The contact arm holder 3 is of substantially rectangular cross-section.

The contact arms 2, 2' are spaced from one another in a transverse direction Q pointing at right angles to the plug-in direction S, and are connected together by way of a contact yoke 5 at their ends 4, 4' pointing in the plug-in direction S. The contact arms 2, 2' are in particular immobile in the embodiment shown, relative to one another and enclose together with the contact yoke 5 a slot-shaped intermediate space Z, which extends in the plug-in direction S and is defined in and contrary to the transverse direction Q by the contact arms 2, 2'. The intermediate space Z ends contrary to a deflection direction A at right angles to the plug-in direction S and to the transverse direction Q at the contact arm 2".

Over the course of the contact arms 2, 2', the arms bend in bend sections 6, 6' in the direction of the deflection direction A and extend in these bend sections 6, 6' angled relative to the plug-in direction S. After the bend sections 6, 6' in the plug-in direction, the contact arms 2, 2' extend in middle sections 7, 7' substantially in the plug-in direction S. The middle sections 7, 7' are formed with contact sections 8, 8', which are here shown pointing in the deflection direction A and away from the contact element 1. The contact sections 8, 8' are shown as extending parallel to one another, but they may also be angled relative to one another. After the middle sections 7, 7' in the plug-in direction S, the contact arms 2, 2' extend in insertion sections 9, 9' once again angled relative to the plug-in direction S, wherein the contact arms 2, 2' are here shown angled contrary to the deflection direction A. At end sections 10, 10' pointing in the plug-in direction S, at which the contact arms 2, 2' are connected together by way of the contact yoke 5, the contact arms 2, 2' again extend in the plug-in direction S. In particular, the end sections 10, 10' may be aligned with the contact arm holder 3 in the plug-in direction S. The contact yoke 5 tapers in its course in the plug-in direction S and forms a free end of the firmly connected-together contact arms 2, 2'.

At its end 11, directed away from the plug-in direction S and connected to the contact arm holder 3, the contact arm 2" is shown angled contrary to the deflection direction A or inclined relative to the plug-in direction S, wherein the end 11 of the contact arm 2" is shown to be arranged upstream of the bend sections 6, 6' of the contact arms 2, 2' in the plug-in direction S. The intermediate space Z ends contrary to the plug-in direction S in the area of this end 11. In its further course pointing in the plug-in direction S the contact arm 2" includes a middle section 12, which extends in the plug-in direction S. The middle section 12 of the contact arm 2" may be oriented at an angle relative to the plug-in direction S, but also at least partially contrary to the deflection direction A. The contact arm 2" is positioned at least in its middle section 12 with a contact section 8" pointing away from the contact element 1. The end of the middle section 12 pointing in the plug-in direction S is adjoined by an insertion section 13, which is angled relative to the plug-in direction S in the deflection direction A and whose free end 14 projects into the portion of the intermediate space Z defined by the insertion sections 9, 9' and the contact yoke 5.

The insertion sections 9, 9', 13 are configured in such a way that they cause the contact element 1 to taper in its end region pointing in the plug-in direction S, wherein the insertion sections 9, 9', 13 are shown in each case with an insertion bevel 15, 15', 15". The insertion bevels 15, 15', 15" extend parallel to the transverse direction Q, are angled relative to the plug-in direction S and point away from the contact element 1.

The contact arm 2" is constructed to be resiliently deflectable at least by way of its end 11 connected with the contact arm holder 3 or its middle section 12 and may be deflected at least in part in the deflection direction A. The contact arm 2" then generates a spring force F directed contrary to the deflection direction A. The intermediate space Z is dimensioned such that the resiliently deflectable contact arm 2" may move at least in part further into the intermediate space Z.

The contact arm holder 3 is positioned on its side 16 pointing in the deflection direction with a retaining pin 17 of cylindrical construction extending in the deflection direction A. The retaining pin 17, serves to secure a spring clip shown and described later. The retaining pin 17 may be constructed in one piece with the contact arm holder 3 or be inserted as a separate retaining pin 17 in an opening provided for said retaining pin 17 in the contact arm holder 3. Alternatively, the retaining pin 17 may also take the form of a possibly hump-shaped snap-in elevated portion or as a snap-fastening recess.

The spring clip may however also be connected in some other way to the contact arm holder 3. For example, the spring clip may be riveted, screwed, welded or soldered to the contact arm holder 3. In particular, the spring clip may be connected electrically conductively to the contact arm holder 3.

Figure 2:
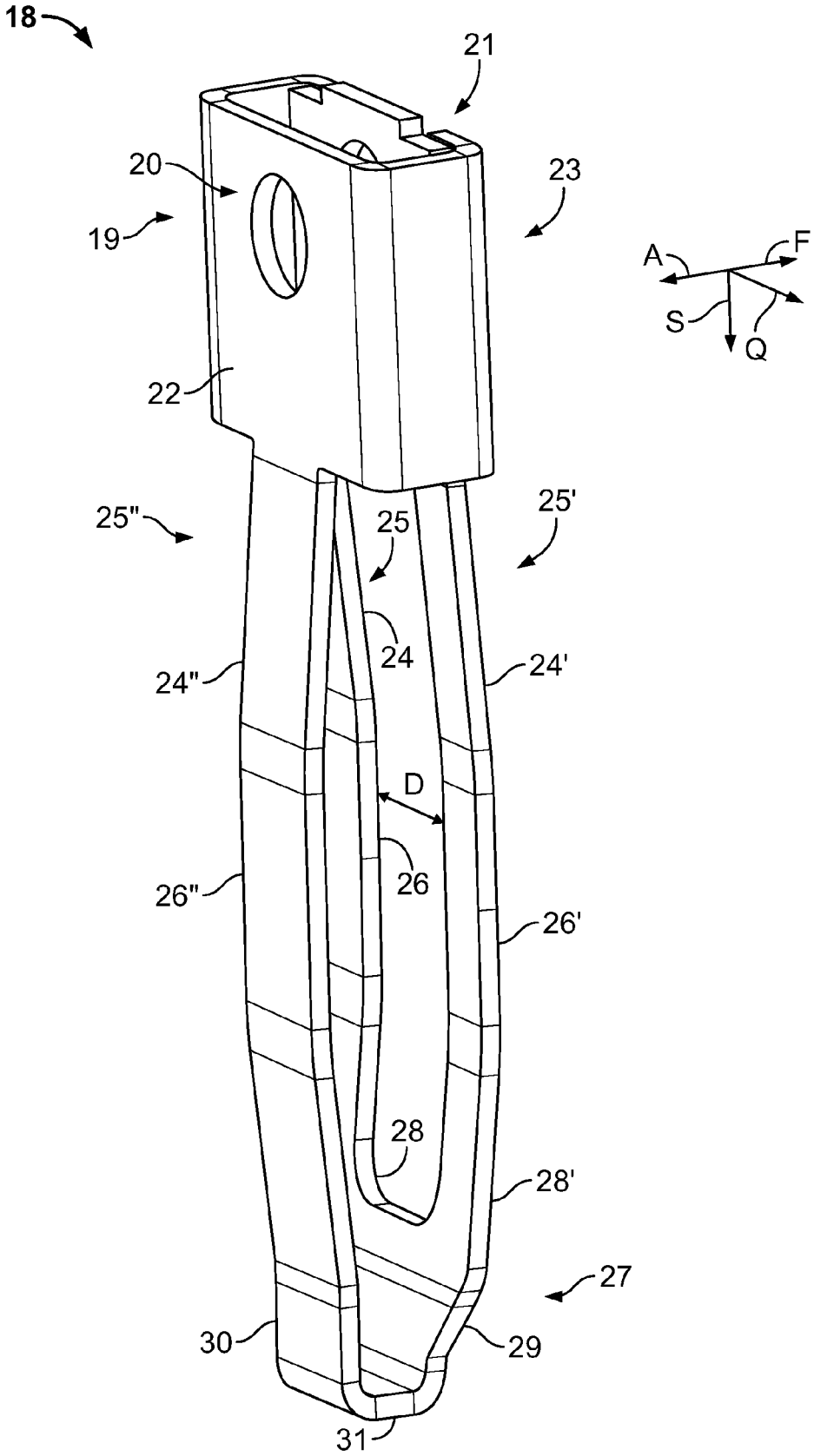
FIG. 2 is a perspective view of a spring clip of the contact arrangement according to the invention.

FIG. 2 is a perspective view a spring clip 18 according to the invention, which may be placed onto the contact element 1. The spring clip 18 is provided with a hollow-cylindrical end section 19 at its end situated contrary to the plug-in direction S. The hollow-cylindrical end section 19 is of substantially rectangular cross-section.

The end section 19 includes fastening openings 20, 21 for fastening the spring clip 18 to the retaining pin 17, with the openings extending in the deflection direction A. If the contact arm holder 3 of the contact element 1 includes differently configured fastening means, the end section 19 may be adapted thereto. In particular, the end section 19 may be weldable or solderable to the contact element 1.

The side faces 22, 23 include the fastening openings 20 and 21 and extending parallel to the transverse direction Q are adjoined in the plug-in direction S by three spring arms, which take the form in particular of complementary spring arms 24, 24', 24" and extend substantially in the plug-in direction S. The complementary spring arms 24, 24', 24" are designed to be deformable in or contrary to the deflection direction A.

The complementary spring arms 24, 24' are positioned next to one another in the transverse direction Q and substantially aligned with one another. The complementary spring arms 24, 24' extend in bend sections 25, 25' at least partially away from a bend section 25" of the complementary spring arm 24". In the plug-in direction S, the complementary spring arms 24, 24', 24" extend in a middle section located downstream of the bend section 25, 25', 25" in the plug-in direction S at least in part parallel to the plug-in direction S. In the middle sections the complementary spring arms 24, 24', 24' are provided with pressure sections 26, 26', 26" pointing away from the spring clip 18. In the region of the end 27, pointing in the plug-in direction S of the spring clip 18, the complementary spring arms 24, 24', 24" extend at least partially towards one another. The complementary spring arms 24, 24' are connected together by way of an insertion plate 29 at their ends 28, 28' pointing in the plug-in direction S. In the deflection direction A, the insertion plate 29 extends substantially angled relative to the plug-in direction S towards the complementary spring arm 24". The insertion plate 29 and the end 30 of the complementary spring arm 24" pointing in the plug-in direction S are securely connected together by way of a clip yoke 31.

In particular, the spring clip 18 may be made from one piece of readily resilient contact material, for example, spring bronze. When viewed from the transverse direction Q, the complementary spring arms 24, 24', 24" enclose a substantially convex cavity and form a loop. If the complementary spring arms 24, 24', 24" are moved towards one another in or contrary to the deflection direction A, the clip yoke 31 may move in the plug-in direction S.

The two complementary spring arms 24, 24' are aligned substantially with one another in the transverse direction Q and extend parallel to one another at a distance D.

Figure 3:
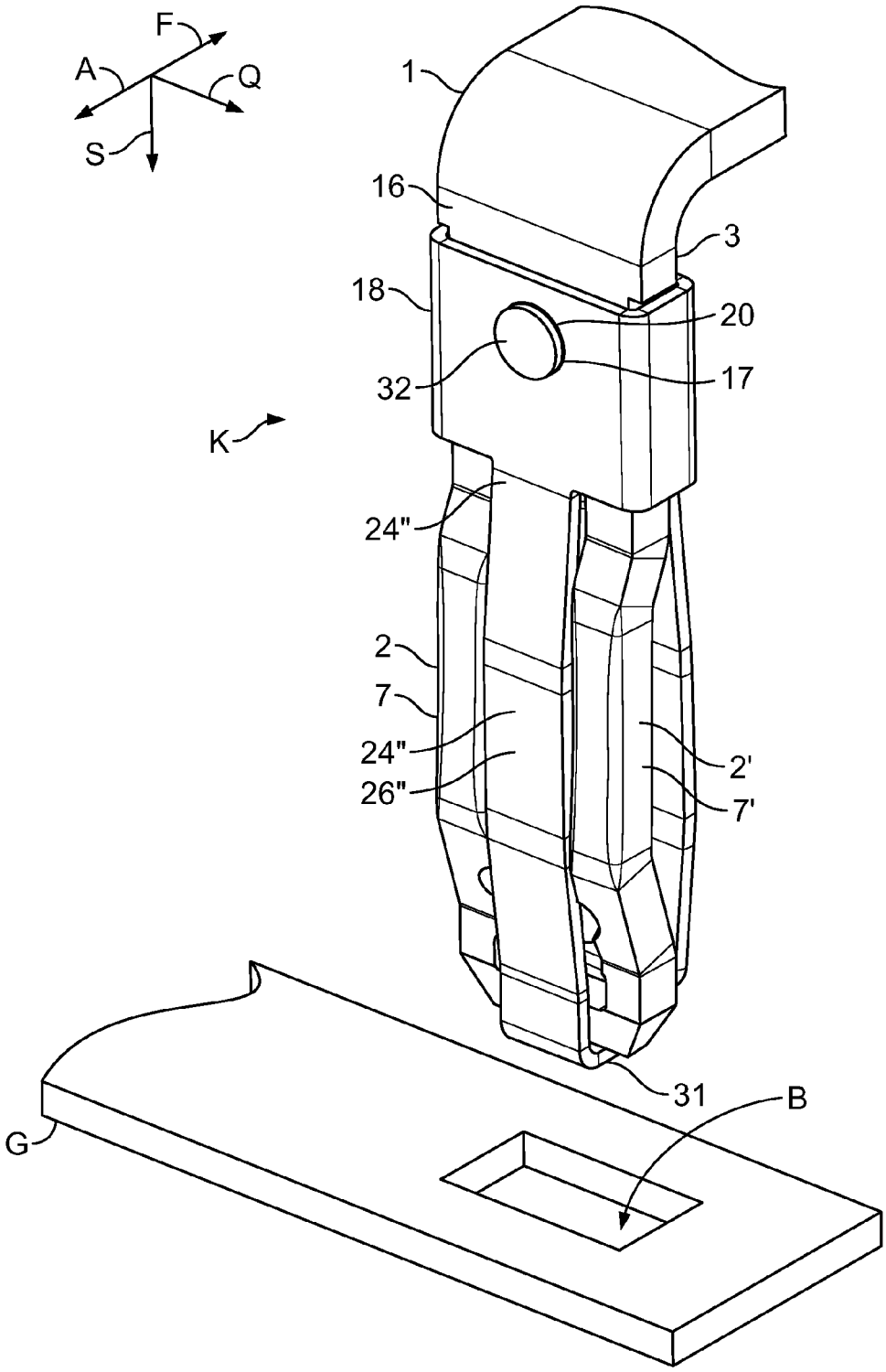
FIG. 3 is a perspective view of the contact arrangement with a mating contact.

FIG. 3 shows a another contact arrangement K according to the invention with a mating contact, the same reference signs being used for elements which correspond in function and structure to the elements of the exemplary embodiments of FIG. 1 or 2. For the sake of brevity, only the differences from the exemplary embodiments of FIGS. 1 and 2 will be looked at.

In addition to the contact element 1, FIG. 3 also shows the mating contact G, which consists of a busbar of rectangular cross-section. The mating contact G includes a socket B, which is likewise of rectangular cross-section transversely of the plug-in direction S and has been punched through the mating contact G in the plug-in direction S.

In FIG. 3 the spring clip 18 is shown placed onto the contact element 1 contrary to the plug-in direction S, wherein the opening 20 in the end section 19 has been pushed over the retaining pin 17 provided on at least one side of the contact arm holder 3. To make it easier to push the spring clip 18 onto the contact element 1 and latch the opening 20 together with the retaining pin 17, the side 32 pointing in the deflection direction A may be angled relative to the plug-in direction S, such that the retaining pin 17 has a wedge-shaped cross-section and its end pointing in the plug-in direction S ends flush with the side 16 of the contact arm holder 3 pointing in the deflection direction A. The side 32 of the retaining pin 17 thus forms a lead-in bevel.

The complementary spring arm 24" extends at least partially in the intermediate space Z arranged between the contact arms 2, 2', wherein at least the middle sections 7, 7' of the contact arms 2, 2' and the middle section of the complementary spring arm 24" extend substantially parallel to one another. The clip yoke 31 terminating the spring clip 18 in the plug-in direction S is positioned downstream of the contact yoke 5 in the plug-in direction and, in the basic position shown here, in which the contact arrangement K has not been inserted into the socket in the mating contact, may rest against the contact yoke 5. Alternatively, the clip yoke 31 may also already be spaced from the contact yoke 5 in the plug-in direction S even in the basic position, in order to compensate manufacturing tolerances acting in the plug-in direction S.

Figure 4B:
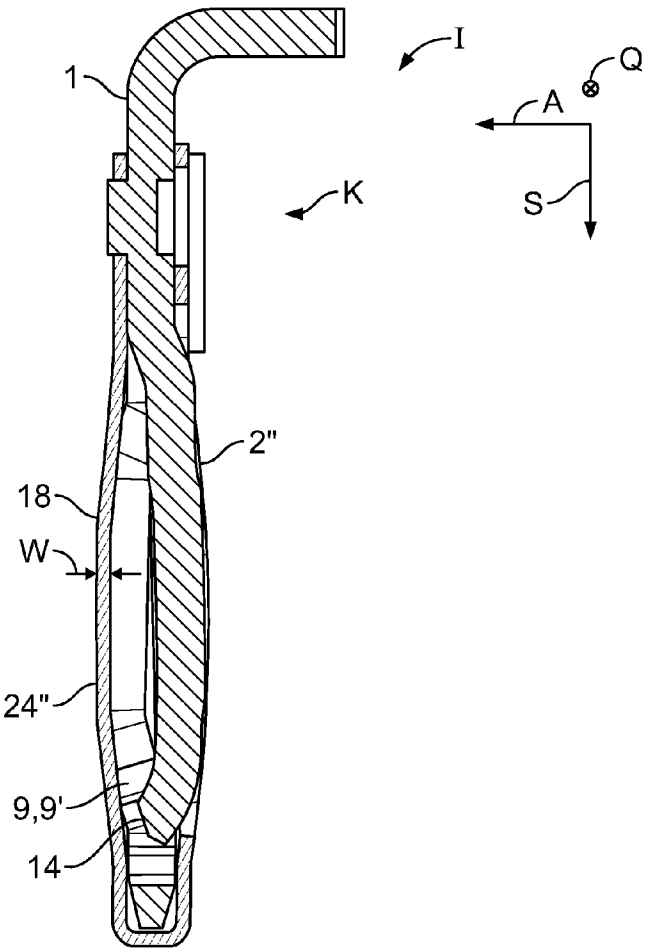
FIG. 4*b* is a sectional view of the contact arrangement of FIG. 4*a;*
Figure 4A:
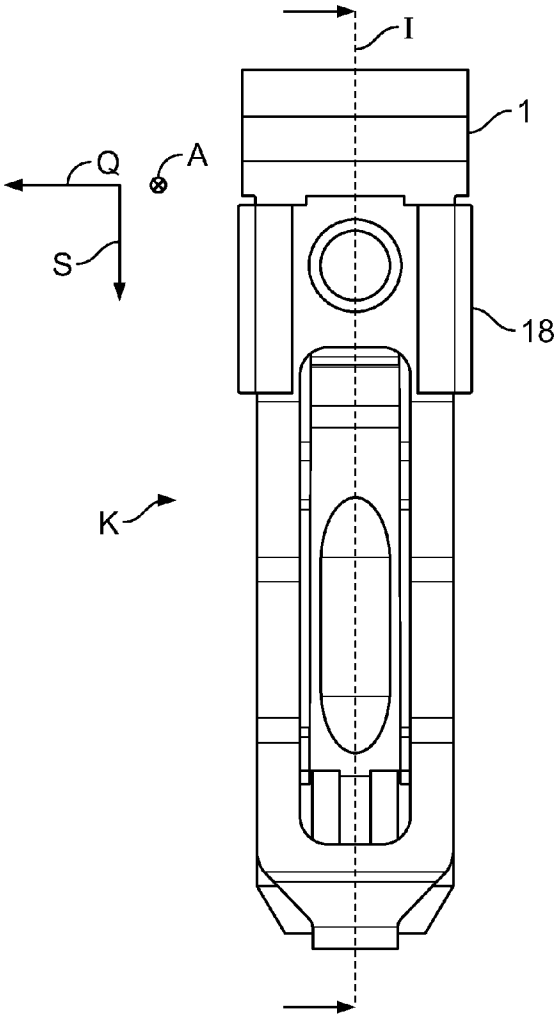
FIG. 4*a* is a front view of the contact arrangement of FIG. 3.

FIG. 4*a* is a frontal view in the deflection direction A of the contact arrangement K of FIG. 3 with the spring clip 18 placed onto the contact element 1. A section plane I extends perpendicularly to the plane of the drawing in the deflection direction A and the plug-in direction S and cuts centrally through the contact element 1 in the transverse direction Q.

FIG. 4*b* is a sectional side view of the exemplary embodiment of FIG. 4*a*, the same reference signs being used for elements which correspond in function and structure to the elements of the exemplary embodiment of FIG. 4*a*. For the sake of brevity, only the differences from the exemplary embodiment of FIG. 4*a* will be looked at.

The section plane I of FIG. 4*a* extends, as is apparent from FIG. 4*b*, through the resiliently deflectable contact arm 2" and through the complementary spring arm 24" arranged between the contact arms 2, 2'. In this view in particular it is apparent that the resiliently deflectable contact arm 2" and the complementary spring arm 24" both arch away from one another in their course directed in the plug-in direction S thereof. The complementary spring arms 24, 24' arranged in front of and behind the resiliently deflectable contact arm 2" in the transverse direction Q are arched contrary to the deflection direction A. The contact arms 2, 2' surrounding the spring arm 24" in the transverse direction Q are arched in the deflection direction A. Altogether, in this view the contact arrangement K has a biconvex basic shape.

The free end 14 of the resiliently deflectable contact arm 2" is shown arranged at least in part next to the insertion sections 9, 9'. The complementary spring arm 24" lying opposite the resiliently deflectable contact arm 2" is configured as a limit stop for the free end 14 of the resiliently deflectable contact arm 2". Thus the resiliently deflectable contact arm 2" is secured against overextension in the deflection direction A.

Figure 5:
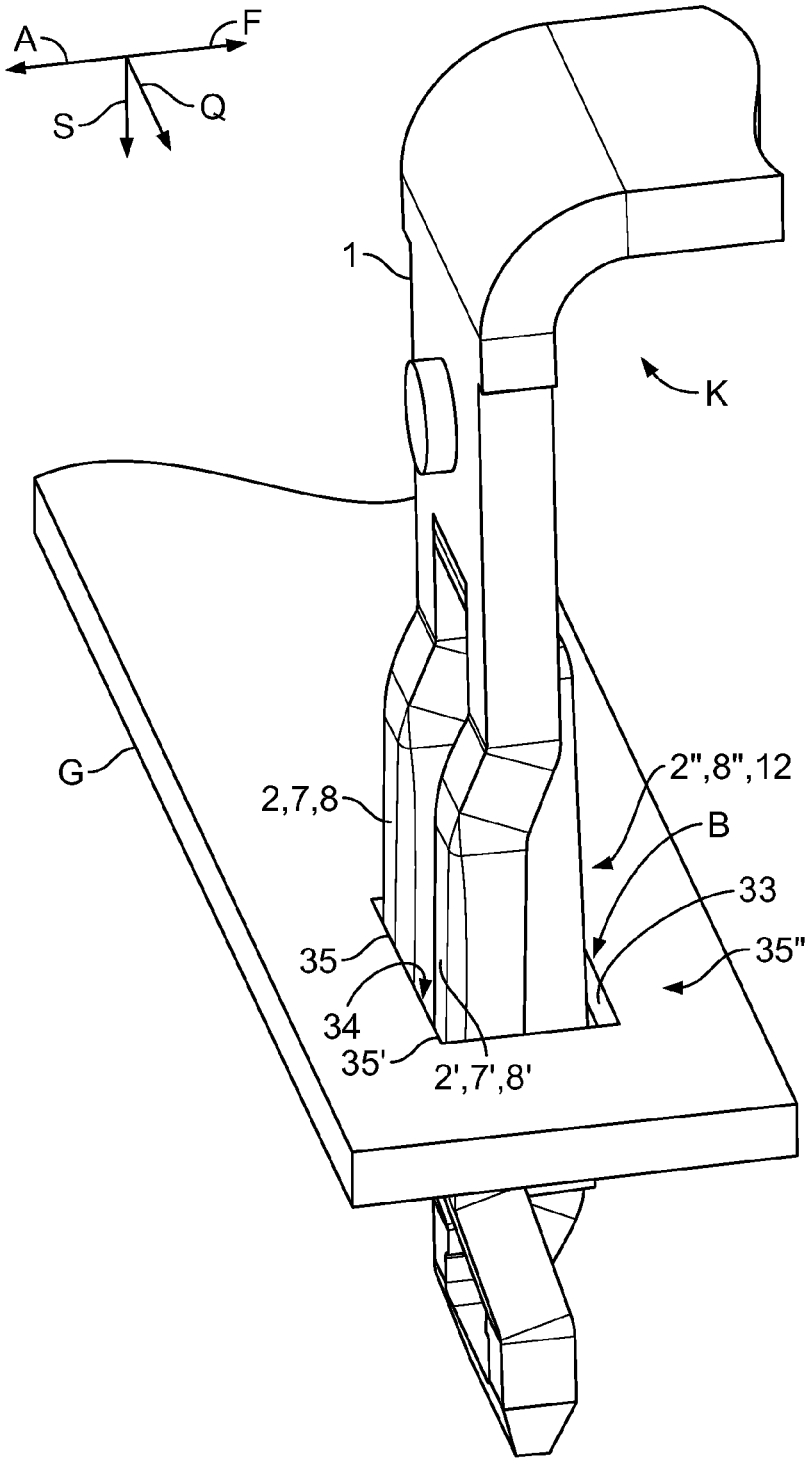
FIG. 5 is a perspective view of another contact element of a contact arrangement according to the invention, being inserted into a socket of the mating contact.

In the deflection direction A the complementary spring arms 24, 24', 24" have a width W, which is smaller in the exemplary embodiment shown here than the width of the contact arms 2, 2', 2" in this direction. However, the width W of the complementary spring arms 24, 24', 24" may also be greater than in the exemplary embodiment shown here and may in particular correspond to the width of the contact arms 2, 2', 2" in the same direction. This may improve the electrical conductivity of the spring clip 18. FIG. 5 shows a further exemplary embodiment of the invention, the same reference signs being used for elements which correspond in function and structure to the elements of the exemplary embodiments of the previous Figures. For the sake of brevity, only the differences from the exemplary embodiments in the above-described Figures will be looked at.

In FIG. 5 the contact element 1 is shown with the middle sections 7, 7', 12 of the contact arms 2, 2', 2" inserted in the plug-in direction S into the socket B of the mating contact G. The resiliently deflectable contact arm 2" is deflected in the deflection direction A and presses with the spring force F directed contrary to the deflection direction A against a contacting face 33 of the socket B pointing in the deflection direction A. The contact section 8" of the contact arm 2" thus rests in an electrically conductive manner against the contacting face 33.

The contact sections 8, 8' of the contact arms 2, 2' rest against a further contacting face 34, opposite the contacting face 33, of the socket B, the contact sections 8, 8' resting against the contacting face 34 with the spring force F. The contact element 1 is thus connected electrically conductively with the mating contact G by way of three contact points 35, 35', 35" formed between the contact sections 8, 8', 8" and the contacting faces 33, 34.

The contact element 1 rests with the three contact sections 8, 8', 8" against the contacting faces 33, 34 by way of the contact points 35, 35', 35", whereby the contact element 1 is held in the socket B by means of a three-point support. Such a three-point support secures the contact element 1 in the socket B optimally against twisting, in particular around the plug-in direction S.

In addition to the contact points 35, 35', 35" extending in the transverse direction Q, the contact element 1 may be connected to the mating contact G by way of at least one further contact point extending in the deflection direction A. Thus, for example, the contact arm 2 may rest against a side of the socket B pointing in the transverse direction Q, so forming an electrically conductive contact point. Altogether, the contact element 1 may thus be connected to the mating contact G by way of up to five contact points 35, 35', 35". It may here be advantageous for the rigid contact arms 2, 2' to be resiliently deflectable at least in or contrary to the transverse direction Q and possibly to be convex or bent outwards in this direction. In most cases, however, it is sufficient for the contact element 1 to be connected to the mating contact G by way of the three contact points 35, 35', 35".

Figure 6:
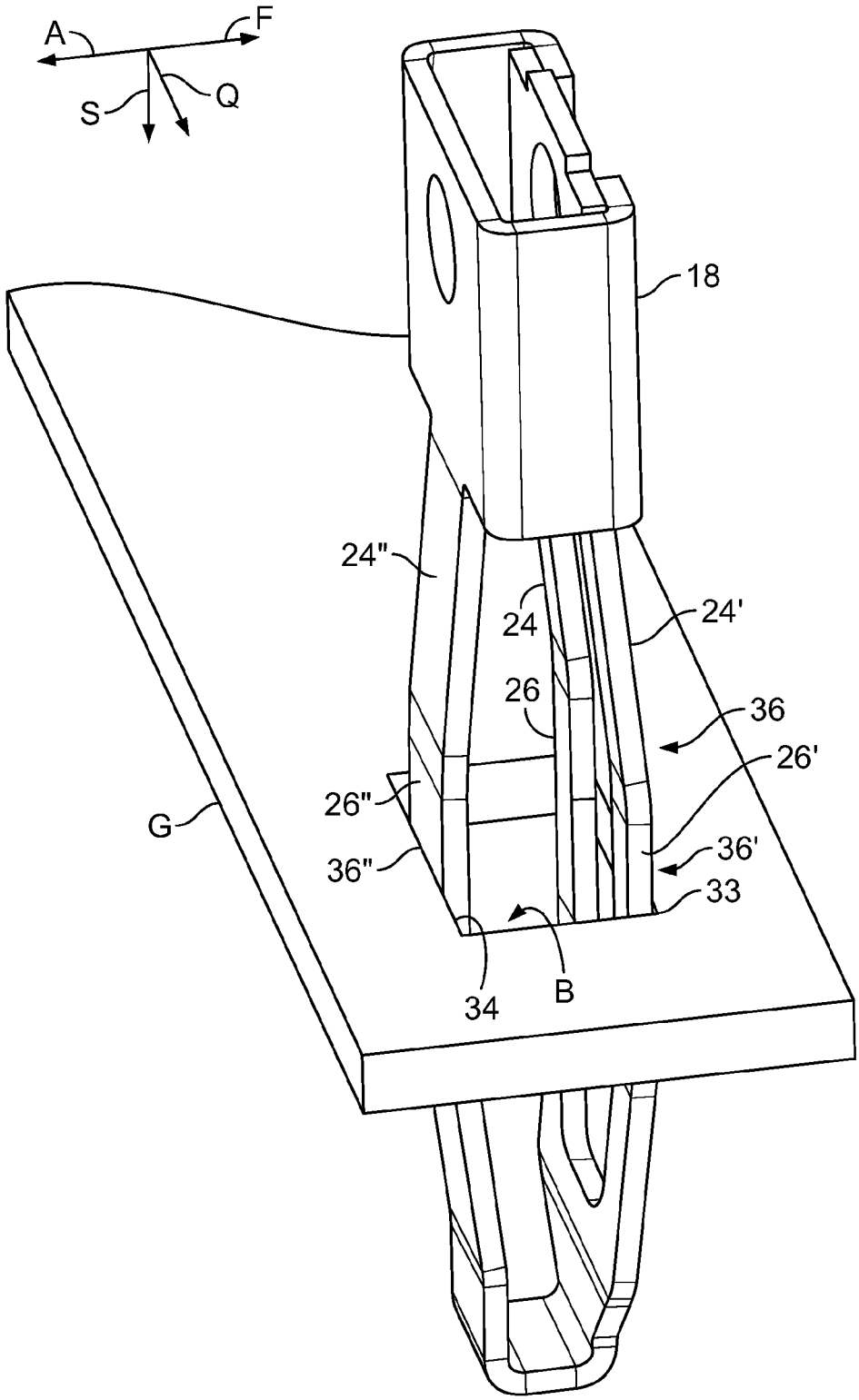
FIG. 6 is a perspective view of another spring clip of a contact arrangement according to the invention, in which the spring clip is shown inserted into the socket of the mating contact.

FIG. 6 shows a further exemplary embodiment of the invention, the same reference signs being used for the elements which correspond in function and structure to the elements of the exemplary embodiments of the previous Figures. For the sake of brevity, only the differences from the exemplary embodiments in the above-described Figures will be looked at.

In order to provide still further contact points in addition to the three above-stated electrical contact points 35, 35', 35", the spring clip 18 may also be used for contacting of the contact element 1 with the mating contact G. In FIG. 6 the spring clip 18 is shown inserted in the plug-in direction S into the socket B of the mating contact G as far as a middle region of its pressure sections 26, 26', 26. Following the insertion process, the complementary spring arms 24, 24', 24" are deflected towards one another and rest against the contacting faces 33, 34. The pressure sections 26, 26', 26" rest substantially against the contacting faces 33, 34 and form together therewith the electrical contact points 36, 36', 36".

The spring clip 18 likewise rests in the form of a three-point support against the contacting faces 33, 34 and in particular against the contact points 36, 36', 36" of the socket B. The pressure sections 26, 26', 26" here rest against the contacting faces 33, 34 and thus also secure the spring clip 18 against twisting, in particular around the plug-in direction S.

Figure 7:
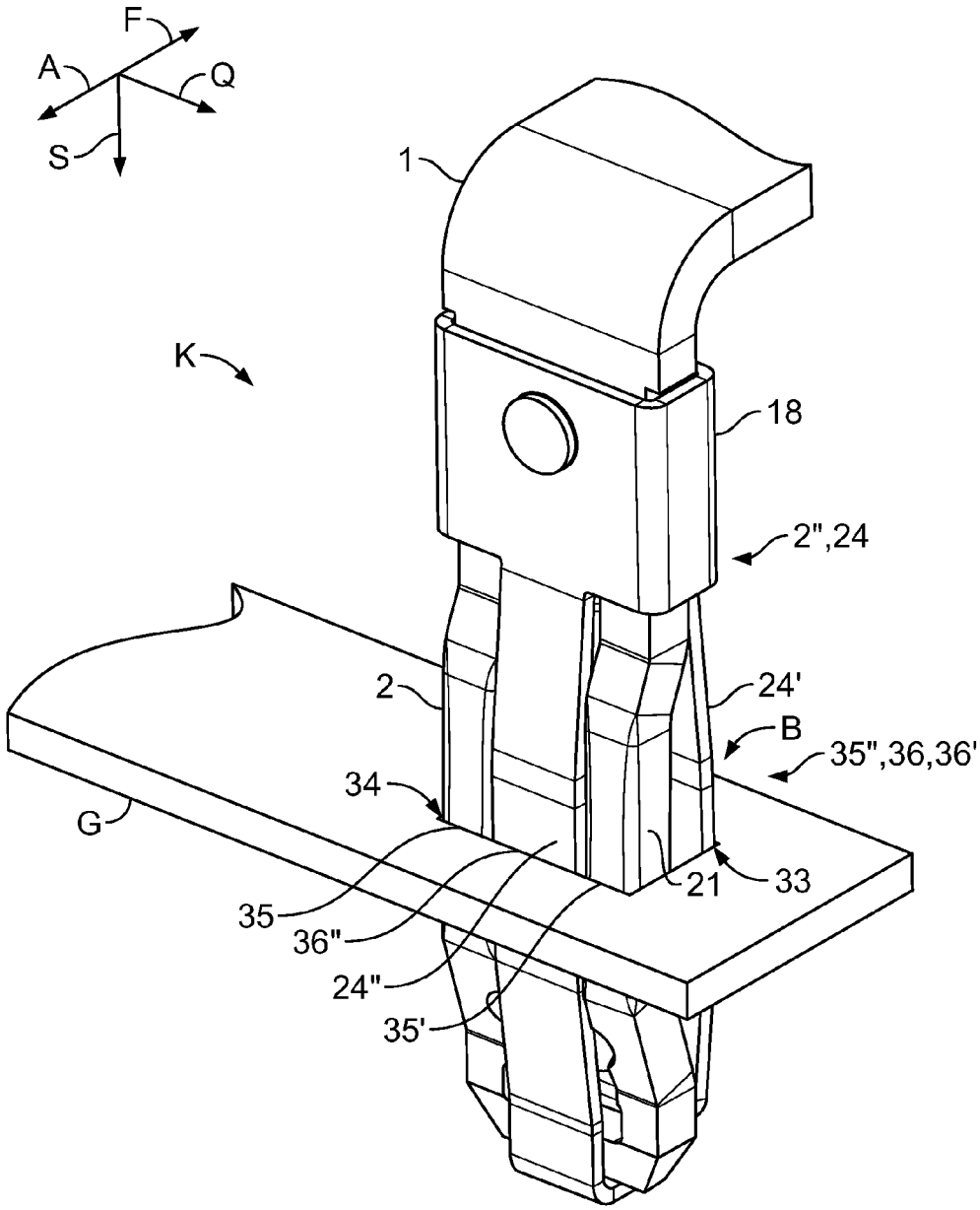
FIG. 7 is a perspective view another contact arrangement according to the invention that inserted into the socket of the mating contact.

FIG. 7 shows a further exemplary embodiment of the contact arrangement, the same reference signs being used for the elements which correspond in function and structure to the elements of the exemplary embodiments of the previous Figures. For the sake of brevity, only the differences from the exemplary embodiments in the above-described Figures will be looked at.

In FIG. 7 both the contact element 1 and the spring clip 18 have been inserted together into the socket B of the mating contact G. Both the resiliently deflectable contact arm 2" and the complementary spring arms 24, 24', 24" are deflected parallel to the deflection direction A into the inside of the contact arrangement K and press against the contacting faces 33, 34 of the socket B. In this way, the contact arms 2, 2' are also pressed against the contacting face 34. Altogether, the contact arrangement K is connected to the mating contact G by way of six contact points 35, 35', 35", 36, 36', 36". In this respect, the contact sections 8, 8', pointing in the deflection direction A, of the contact arms 2, 2' are aligned in the transverse direction Q with the pressure section 26" and form a common and substantially continuous contact surface, which may be interrupted by two narrow slots extending in the plug-in direction S and in front of and behind the complementary spring arm 24" in the transverse direction. The side of the contact arrangement K directed contrary to the deflection direction A and in particular the contact section 8" of the resiliently deflectable contact arm 2" forms together with the pressure sections 26, 26' a second common and likewise substantially continuous contact surface. The contacting faces 33, 34 extending parallel to the transverse direction Q are thus connected in substantially uninterrupted manner with the contact arrangement K, giving rise to a virtually minimal transition resistance between the contact arrangement K and the mating contact G, which latter reliably even conducts pulsed currents of several thousand amperes. As a result of the spring forces applied by the resiliently deflectable contact arm 2" and the complementary spring arms 24, 24', 24", the contact arrangement K is accommodated non-interlockingly in the socket B of the mating contact G and secured against unwanted displacements in the plug-in direction S.

The contact arrangement K is protected optimally against twisting, in particular around the plug-in direction S, by way of the contact element 1 and the spring clip 18, the two of which are in each case held in the socket B by way of a three-point support.

Figure 8A:
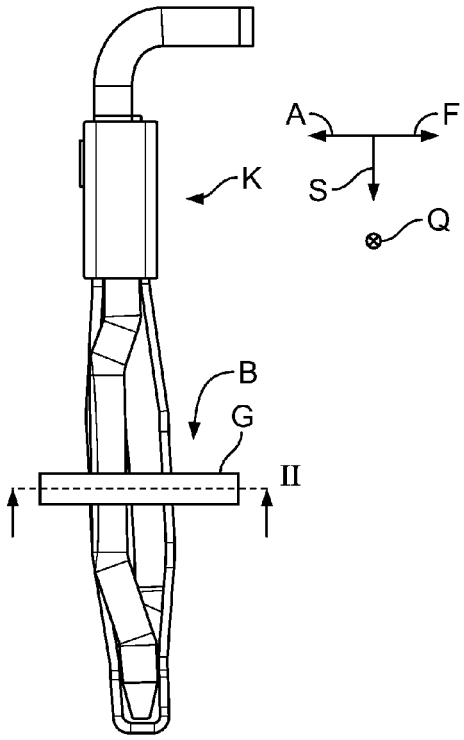
FIG. 8*a* is a side view of the contact arrangement of FIG. 7.

FIG. 8*a* shows a further exemplary embodiment of the contact arrangement K inserted into the mating contact G, the same reference signs being used for elements which correspond in function and structure to the elements of the exemplary embodiments of the previous Figures. For the sake of brevity, only the differences from the exemplary embodiments in the above-described Figures will be looked at.

FIG. 8*a* shows the contact arrangement K and the mating contact G in a side view pointing in the contrary direction to the transverse direction Q. A section plane II extending through the deflection direction A and the transverse direction Q runs substantially through the middle, in the plug-in direction S, of the mating contact G.

Figure 8B:
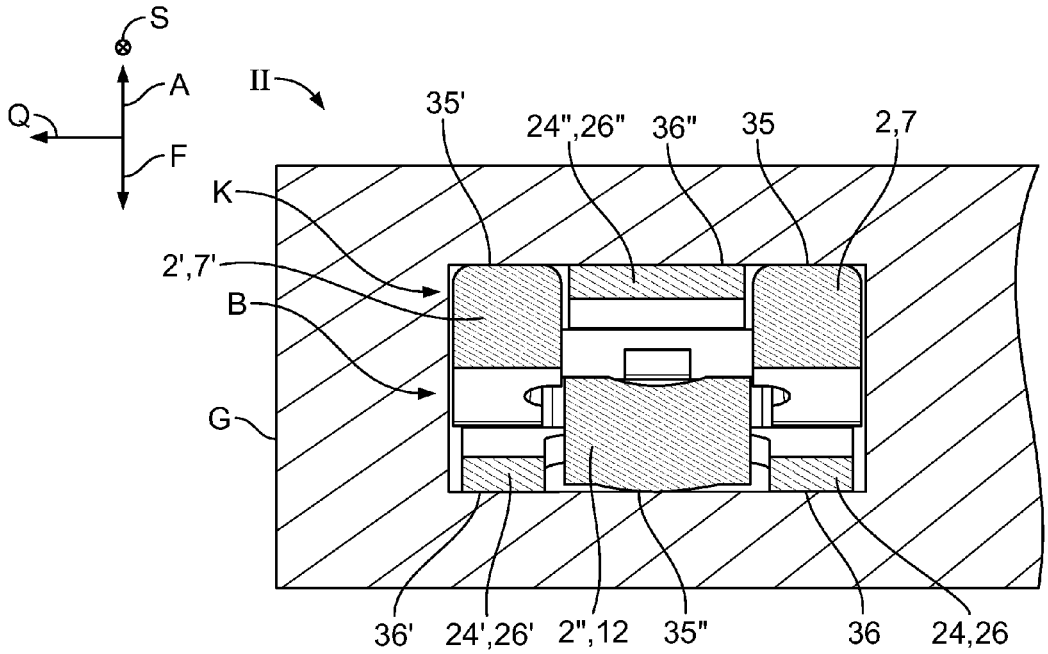
FIG. 8*b* is a sectional view of the contact arrangement of FIG. 8*a*.

FIG. 8*b* shows the exemplary embodiment of FIG. 8*a*, the same reference signs being used for the elements which correspond in function and structure to the elements of the exemplary embodiment of FIG. 8*a*. For the sake of brevity, only the differences from the exemplary embodiments of FIG. 8*a* will be looked at.

In the sectional representation II, the contact points 35, 35', 35", 36, 36', 36" are clearly visible. It is very clear that in the area of the middle sections 7, 7', 12 the contact arms 2, 2', 2" define a cross-section of polygonal and in particular rectangular outline corresponding substantially to the inner contour of the socket. This cross-section is completed by the middle sections and in particular by the pressure sections 26, 26', 26" of the complementary spring arms 24, 24', 24" substantially in such a way that the contact arrangement K arranged in the socket B is configured to be virtually wholly complementary to the inner contour of the socket B. The contact arrangement K rests by way of two substantially mutually independently acting three-point supports on the inside of the socket B and is thus substantially protected against undesired twisting, in particular around the plug-in direction S. This support is promoted and reinforced by the rigid connection between the end section 19 of the spring clip 18 and the contact arm holder 3 of the contact element 1.

Due to the electrical connection of the spring clip 18 with the contact element 1 and the mating contact G, the spring clip 18 acts like an electrical conductor connected in parallel with the contact element 1, whereby the electrical conductivity of the contact arrangement K thus not only results from the enlarged area of the plurality of contact points 35, 35', 35", 36, 36', 36", but also from the enlarged electrical cross-section of the contact arrangement.

The invention is structurally particularly simple and has the advantage that, as a result of the offset arrangement K of the three contact arms 2, 2', 2" relative to one another and in particular of the resiliently deflectable contact arm 2" in the transverse direction Q between the other two contact arms 2, 2', mechanically stable three-point mounting of the contact arrangement in the socket is ensured. Mechanical forces which seek to twist or tilt the contact arrangement K inserted into the socket may be resisted better by the contact arrangement 1 according to the invention, whereby the contact arms 2, 2', 2" rest reliably against the socket B. The electrical plug-and-socket connection is thus markedly more reliable and the service life of the contact arrangement is longer without a socket of complicated construction being required or the contact arrangement occupying more room than the contact arrangements of the prior art.

In addition, the pulsed current may also flow from the contact arrangement K into the socket B through a plurality of contact zones; in the prior art the current flows solely through one contact zone. Using a plurality of contact zones allows the current density to be reduced, so also reducing magnetic or thermal loads in the individual contact zones in comparison with the prior art. The current flowing overall through the contact arrangement may still be high.

The solution according to the invention may be further improved by various configurations which are each in themselves advantageous and may be combined as desired with one another. These configurations and the associated advantages will be looked into below.

According to a first configuration, the contact arms 2, 2', 2" may include contact sections 8, 8', 8" directed away from the contact arrangement K, which contact sections 8, 8', 8" may, in a plane arranged perpendicularly to the plug-in direction S and in which the socket may extend, define at least in part a cross-section of polygonal outline, which cross-section may correspond substantially to the socket B and in particular to the inner contour thereof. The contact sections 8, 8', 8" may here be arranged in a sub-portion of the contact arms 2, 2', 2" in the middle in the plug-in direction S and extend over a large part of the contact arms 2, 2', 2" in the plug-in direction S. For example, the contact sections 8, 8', 8" may be of planar construction, so that they may be placed flush against contacting faces likewise of planar construction of a socket B of rectangular construction, whereby particularly good, maximally extensive electrical contact is produced between contact arrangement and socket.

In particular, the contact sections 8, 8' of the two contact arms 2, 2' may be arranged directed away from the contact section 8" of the resiliently deflectable contact arm 2". This arrangement of the contact sections 8, 8', 8" ensures good connectability of the contact arrangement K with a socket B of rectangular internal contour.

When the contact arrangement K is inserted into the socket B, the resiliently deflectable contact arm 2" may be moved in the deflection direction A at least in part and against a spring force into the interspace Z between the other two contact arms 2, 2'. By means of this spring force, said other two contact arms 2, 2' are also pressed against contacting faces of the socket B. The contact arrangement may be secured against undesired movements at least in the plug-in direction S by means of frictional engagement between the contact sections 8, 8', 8" and the contacting faces in the socket B. In this respect, the spring force applied by the resiliently deflectable contact arm 2" generates a large part of the retaining forces.

In order to distribute the spring force or the retaining forces brought about by the spring force as uniformly as possible between the contact sections 8, 8', 8", the contact arms 2, 2', 2" may form an equilateral triangle and be arranged at the corners thereof, wherein the resiliently deflectable contact arm 2" may be provided at the apex of the triangle. In particular, the deflection direction A may coincide with the bisector of the apex of the triangle. The contact sections 8, 8', 8" of the contact arms 2, 2', 2" arranged at the other corners of the triangle may extend parallel to the base of the triangle connecting these two corners. The triangle may also be equilateral or irregular, depending on the requirements of the socket geometry.

However, if the socket B includes a different, for example hexagonal inner contour, the contact 8, 8', 8" sections arranged in the corners of the equilateral triangle may also be arranged differently and in particular perpendicularly to the connecting lines between the corners of the triangle and a marked point of the triangle. The marked point of the triangle may for example be the center point of an inscribed circle of the triangle or the centre of gravity of the triangle or any other desired marked point. The contact sections 8, 8', 8" may also be differently oriented and in particular extend angled towards one another in the plug-in direction S, in order to extend parallel to the contacting faces of the socket B when inserted thereinto. Advantageously, at least one of the contact sections points away from at least one other contact section to hold the contact arrangement K in the socket B.

The ends 4, 4' pointing in the plug-in direction S of at least two contact arms 2, 2' may be connected rigidly together by way of a contact yoke 5. If the end of the resiliently deflectable contact arm 2" is connected to the end of one of the other contact arms 2, 2', in this way the spring constant of the resiliently deflectable contact arm 2" may be increased. It is particularly advantageous, however, for the ends of the other two contact arms 2, 2" to be connected together, since the spring force is intended to be applied purposefully by the resiliently deflectable contact arm 2", while the other two contact arms 2, 2', being substantially rigid and immovable relative to one another, are intended to introduce the spring force into the socket B.

In order to be able to insert the contact arrangement K simply into the socket B and to prevent the contact arms 2, 2', 2" from becoming hooked together with edge areas of the socket B at least at the start of the insertion process, the ends 4, 4', 14 of the contact arrangement pointing in the plug-in direction S may be of tapered profile, insertion bevels 15, 15', 15" being formed which extend in the transverse direction and are angled relative to the plug-in direction. The insertion bevels 15, 15', 15" may extend at an angle outwards from the contact arrangement K and be of v-shaped arrangement when viewed parallel to the transverse direction Q. Together with the contact yoke 5 adjoining the insertion bevels 15, 15', 15"

in the plug-in direction S, the end of the contact arrangement K pointing in the plug-in direction may be Y-shaped when viewed parallel to the transverse direction Q, wherein the contact yoke 5 may form the perpendicular stroke of the Y pointing in the plug-in direction S.

To protect in particular the resiliently deflectable contact arm 2", which may be provided with a free end 14 in the plug-in direction S, this free end may, in a rest position, in which the resiliently deflectable contact arm 2" is not deflected against the spring force, project into the portion of the slot-shaped interspace Z defined by the contact yoke 5 in the plug-in direction S. The free end 14 of the resiliently deflectable contact arm 2" may thus be protected, at least in the transverse direction Q, by the other two contact arms 2, 2' against undesired movements. In addition, one of the insertion bevels 15, 15', 15" may be arranged at the free end, such that the free end is also protected in the deflection direction against undesired movements.

In addition to the individual, resiliently deflectable contact arm 2", the other two contact arms 2, 2', which transversely define the interspace Z and which, in the aforementioned description of the invention, may be regarded as being of rigid construction, may also be resiliently deflectable at least parallel to the deflection direction A and in particular contrary to the deflection direction A.

In this way, the contact arrangement K may be conformed still better to any unevenness which may possibly be present in the socket configuration. For example, the contacting faces of the sockets B may extend at an angle towards one another and thus deviate from a preferred parallel profile. All the resiliently deflectable contact arms 2, 2', 2" may respond at least partially mutually independently to such deviations and compensate them.

The configuration of the contact arrangement K with three resiliently deflectable spring arms 2, 2', 2" is also particularly advantageous if forces act on the contact arrangement K positioned in the socket B and seek to twist the contact arrangement K.

In this case in particular, a plurality of and in particular all three resiliently deflectable contact arms 2, 2', 2" may secure the electrical connection, by on the one hand counteracting the externally acting forces with spring forces which may secure the position of the contact arrangement K and on the other hand being able to effect compensating movements if the external forces should lead to twisting of the contact element 1 in the socket B.

It is particularly advantageous for each of the resiliently deflectable contact arms 2" already to be configured or designed as a spring portion for fixing the contact arrangement K in the socket B. Thus, the resiliently deflectable contact arm 2" may fulfil twin functions, in which it takes the form both of a conductor withstanding high pulsed currents and of a spring portion giving rise to retaining forces.

For example, the resiliently deflectable contact arm 2" may be of a different geometry from the other two contact arms 2, 2', possibly being thinner in the deflection direction, at least in part, whereby its resilience is increased in comparison to the other two contact arms and it is more readily deformable. The resiliently deflectable contact arm 2" may also be made from a material which has better resilient characteristics and is possibly softer than the material from which the other two contact arms 2, 2' are made.

In an in itself particularly advantageous development, the material and geometry of the three contact arms 2, 2', 2" may be substantially the same, wherein in particular the cross-section of the contact arms 2, 2', 2" perpendicular to the plug-in direction S may be substantially identical. The other two contact arms 2, 2' may then be regarded as a second resiliently deflectable contact arm, whose spring constant in or contrary to the deflection direction may be approximately twice the spring constant of the originally individual resiliently deflectable contact arm 2".

Alternatively, the other two contact arms 2, 2' may also be designed in such a way that their spring constants are lower, possibly even in total, than the spring constant of the third resiliently deflectable spring arm 2". For example, the other two contact arms 2, 2' may be thinner, at least in part and in particular in an area applying the spring force, than the one resiliently deflectable contact arm 2".

In order to obtain a contact arrangement K which may be handled in one piece, the ends of the contact arms 2, 2', 2" pointing in the opposite direction from the plug-in direction S may be shaped as part of a contact element 1 and joined together. The contact arms 2, 2', 2" may in this case be joined together by way of a contact arm holder and for example screwed, riveted, welded or soldered thereto. Of particular advantage is a configuration in which the contact arm holder and the contact arms 2, 2', 2" are shaped in one piece, for example from a piece of high conductivity metal.

To improve further the mechanical connection between the contact arrangement K and the socket B of the mating contact, the contact arrangement K may include a spring clip 18. Like the contact arms 2, 2', 2", the spring clip 18 may for example be constructed in one piece with the contact arm holder. However, it is simpler to produce a separate spring clip 18, which may be placed on the contact element 1 in the opposite direction from the plug-in direction S.

Once the spring clip 18 has been placed in an assembled state onto the contact element 1, so as to complete the contact arrangement K, the spring clip 18 may be resiliently deformed at least in part in or contrary to the deflection direction S. Once inserted into the socket B, the spring clip 18 rests against the two mutually opposing contact surfaces of the socket B and contributes in the plug-in direction S, through frictional engagement with the socket, to securing of the contact arrangement K against undesired displacement in the plug-in direction S.

The spring clip 18 may include a hollow cylindrical end section, which may be slid over the contact arm holder. The contact arm holder may then be received in a substantially complementary manner in the hollow cylindrical end section of the spring clip 18. In the plug-in direction S, the end section of the spring clip 18 that is placed onto the contact element 1 may for example be secured by way of the retaining clip 17, i.e. a dowel pin, against movement relative to the contact arm holder. In addition, the end section may be configured in such a way that it lies tightly against the contact arm holder and is substantially immobile relative to the contact arm holder. A cuboidal configuration of the contact arm holder contributes to this, since retaining faces of flat construction, against which the end section on the contact arm holder may rest, support the end section optimally against twisting around the plug-in direction S.

Instead of a retaining 17, or dowel pin, the end section may also be screwed or riveted together with the contact arm holder. If the spring clip 18 is also intended to be connected electrically conductively with the contact element 1, a bonded joint is particularly advantageous. Soldering or welding are bonded joints worthy of particular consideration here.

The spring clip 18 may include a plurality of spring arms 24, 24', 24", which may rest in the socket B in a number of directions. In the assembled state, in which the spring clip 18 has been placed onto the contact element 1 contrary to the plug-in direction S, at least three of these spring arms 24, 24', 24" may extend substantially in the plug-in direction S. To make the contact arrangement K as compact as possible, these three spring arms 24, 24', 24" extending in the plug-in direction may take the form of complementary spring arms, wherein two of the complementary spring arms 24, 24' may, in the assembled state, be arranged transversely in front of and behind the resiliently deflectable contact arm 2". The third complementary spring arm 24" may be arranged between the other two contact arms 2, 2'. Such an arrangement of the complementary spring arms 24, 24', 24" relative to the contact element 1 may result in a contact arrangement of compact cross-section, which turns out to be only insignificantly larger, if at all, than the cross-section of the contact arrangements in the prior art.

To protect the complementary spring arms 24, 24', 24" against undesired deflection above all during insertion of the contact arrangement K into the socket B, the ends of the complementary spring arms 24, 24', 24" pointing in the plug-in direction S may be joined together by way of a, possibly rigid, clip yoke 5. In the assembled state this clip yoke 5 may be arranged downstream of the contact yoke 5 in the plug-in direction S and spaced from the contact yoke 5 at least when the contact arrangement K has been inserted into the socket B.

To simplify insertion of the contact arrangement K into the socket B, the spring clip 18 may also taper in the plug-in direction S, wherein the ends pointing in the plug-in direction of the opposing complementary spring arms 24, 24', 24" may curve towards one another in the deflection direction A.

As an alternative, the ends, situated in the plug-in direction, of the complementary spring arms 24, 24', 24" to the front or rear in the deflection direction A may be connected to the clip yoke 5 by way of an insertion plate angled away from the spring clip 18 in relation to the plug-in direction S and be constructed as a loop when viewed in the transverse direction Q.

The complementary spring arm 24" arranged in the interspace Z may cover the resiliently deflectable contact arm 2" at least in part in the deflection direction A and thus prevent overextension of the resiliently deflectable contact arm 2" in the deflection direction A. In particular, the free end of the resiliently deflectable contact arm 2" may strike against the complementary spring arm 24" in the case of impending overextension of the contact arm 2".

In addition, the complementary spring arms 24, 24', 24" may be arranged or shaped to complete the polygonal cross-section defined at least in part by the complementary spring arms 24, 24', 24" so as substantially to yield the socket cross-section. Thus, the cross-section of the contact arrangement K extending perpendicularly to the plug-in direction S may be even better conformed to the cross-section of the socket B. Consequently, the volume available in the socket is put to optimum use and above all the contacting faces of the socket B are connected substantially fully with the contact arrangement K. To this end, it may be particularly advantageous for any gap between the spring arms 24, 24', 24" and the contact arms 2, 2', 2"adjacent thereto to be as small as possible. The spring arms 24, 24', 24" and the contact arms 2, 2', 2" may possibly even rest against one another in the transverse direction Q. However, this requires very precise manufacture both of the contact element 1 and of the spring clip 18.

In a sub-portion of the complementary spring arms 24, 24', 24" positioned in the middle in the plug-in direction, pressure sections pointing away from the spring clip 18 may be arranged, which may be configured to lie extensively against the contacting faces of the socket B. If the socket includes a hexagonal inner contour, for example in a plane extending transversely of the plug-in direction S, the pressure sections may be arranged in such a way relative to the contact sections of the contact arms 2, 2', 2" that the contact arrangement K substantially resembles a hexagonal cylinder extending in the plug-in direction. In this case, the pressure sections may also be arranged in the corners of a possibly equilateral triangle, wherein the pressure section arranged in the intermediate space Z may be provided at the apex of the triangle and the pressure sections may possibly be oriented perpendicularly to lines extending through a marked point of the triangle and through the corners thereof. The two triangles, in which the contact sections or the pressure sections are arranged, may be identical to one another, wherein the triangles may extend in a common plane and may be rotated in this plane by 180 degrees relative to one another.

There is also a possibility of the socket B having a triangular cross-section. In this case, either the contact sections of the contact arms 2, 2', 2" or the pressure sections of the complementary spring arms 24, 24', 24" may be shaped in such a way that they may possibly be arranged in a form-fitting manner in the corners of the triangle. The portions not arrangeable at the corners may be placed against sides of the socket B extending between the corners.

The contact arrangement may also be used with differently shaped polygonal bushings, wherein at least the contact arms may be arranged as described above and may rest in the socket transversely of the plug-in direction by way of a three-point support.

However, if the socket B has a rectangular cross-section, in the assembled state the pressure sections may be aligned with the contact sections of the contact arms 2, 2', 2" in the transverse direction Q at least when the contact arrangement K has been inserted into the socket. In this way, the contacting faces may be connected substantially over their full area with the contact arrangement K, whereby the contact arrangement K may be received in a particularly stable manner in the socket B.

Combining in particular the contact element 1 according to the invention with three contact arms 2, 2', 2" and the spring clip 18 according to the invention with three complementary spring arms 24, 24', 24" gives rise to a highly stable mechanical connection between socket B and contact arrangement K. This connection protects the contact arrangement K from twisting in particular around the plug-in direction. Both the contact element 1 and the spring clip 18 in each case form a three-point support with the contacting faces of the socket B. The six contact points between contact arrangement K and socket B do not result in a mechanically over rigid connection, since the spring clip 18 and the contact element 1 are only connected together rigidly in the area of the contact arm holder and the complementary spring arms 24, 24', 24" and the contact arms 2, 2', 2" rest separately from one another against the contacting faces due to their resilience and so create two three-point supports acting at least partially independently of one another.

If the spring clip 18 is intended to contribute appreciably to the electrical conductivity of the contact arrangement K, the spring clip 18 may be connected electrically conductively to the contact element 1 and in particular to the contact arm holder. It is advantageous for this purpose for the end section of the spring clip 18 to rest substantially over its entire surface against the contact arm holder and possibly even to be joined thereto in bonded manner at least in part. The contact arm holder and the end section may form a first current node, wherein the complementary spring arms 24, 24', 24" and the contact arms 2, 2', 2" between said first current node and the contacting faces of the socket B, which form a second current node, may be regarded as two electrical conductors connected together in parallel. If contact and complementary spring arms 24, 24', 24" lying next to one another are in extensive contact with one another, the contact element 1 and the spring clip 18 may function as a single large cross-section electrical conductor.

In order to be able to ensure as uniform as possible a flow of current both through the contact arms and through the complementary spring arms 24, 24', 24", the width of the complementary spring arms 24, 24', 24" transversely of the plug-in direction S may correspond to the width of the contact arms 2, 2', 2" in this direction. If in particular the widths in the deflection direction correspond, or the complementary spring arms 24, 24', 24" and the contact arms 2, 2', 2" have a substantially equally large cross-section and are made from materials with a comparable specific electrical conductivity, the current flow to the socket B may be equally distributed through the contact element 1 and the spring clip 18.

The pressure and contact sections arranged next to one another may form a substantially continuous contact surface, in order to be able to rest over as complete an area as possible against the contacting faces of the socket B and thus allow the smallest possible transition resistance between contact arrangement K and mating contact. In particular, the mutually aligned pressure and contact sections, which are conformed above all to a socket B with a rectangular outline, may form this continuous contact face. Should the contact arrangement K nevertheless become twisted around the plug-in direction S despite the multiple three-point support as a result of exposure to force, at least the complementary spring arms 24, 24', 24" and also the resiliently deflectable contact arm 2" may compensate this movement at least to a certain degree due to their resilient deformability and the retaining forces acting in the direction of the contacting faces of the sockets B, such that the electrical contact between contact arrangement and mating contact remains substantially constant and the current flow even of high pulsed currents is not broken off.

As the result of a spring clip 18 connected to the contact element 1 in an electrically conductive manner, further contact points may be available in addition to the contact points between the contact element 1 and the socket B, namely those between the spring clip 18 and the socket B. In this way, the current flow through the individual contact points may be further reduced, without the entire current flow from the contact arrangement K to the mating contact having to be less; thermal and magneto-mechanical loads caused by the current may be reduced further in this way than without a spring clip 18. In particular, the contact arrangement K with contact element 1 and spring clip 18 may withstand current intensities which may lead to overloading and possibly to damage of the contact element 1 or socket B in a contact arrangement K without spring clip 18.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. Electrical contact arrangement for high pulsed currents and for connection to a polygonal socket comprising:

a contact element which has at least two contact arms which extend substantially in an insertion direction and of which one is constructed so as to be resiliently deflectable relative to the other in a deflection direction which extends perpendicular to the insertion direction, the two contact arms being arranged so as to be spaced apart from each other at least in portions in a deflection direction and there being provided on the contact element an at least one other contact arm which extends in the insertion direction and which is arranged so as to be spaced apart from the other two contact arms in a transverse direction which extends perpendicular to the insertion direction and deflection direction, the at least one other contact arm being movable in the deflection direction at least in portions into an intermediate space between the at least two contact arms and wherein the contact arrangement comprises a spring clip which can be fitted to the contact element counter to the insertion direction and which can be deformed resiliently in or counter to the deflection direction in the assembly state fitted to the contact element.

2. Contact arrangement according to claim 1, wherein the contact arms have contact portions which are directed away from the contact arrangement and which delimit at least in portions a polygonally profiled cross-section, which substantially corresponds to the socket in a plane which is arranged perpendicular to the insertion direction.

3. Contact arrangement according to claim 1 wherein the contact arms are arranged at the corners of an isosceles triangle, with the resiliently deflectable contact arm being provided at the apex of the triangle.

4. Contact arrangement according to claim 1, wherein the ends of at least two contact arms directed in the insertion direction are rigidly connected to each other via a contact yoke.

5. Contact arrangement according to claim 1 wherein the end of the contact arrangement directed in the insertion direction tapers over its extent and forms inclined introduction members which extend in a transverse direction and which are pivoted in relation to the insertion direction.

6. Contact arrangement according to claim 5 wherein one of the inclined introduction members is arranged at the free end of the resiliently deflectable contact arm directed in the insertion direction and the free end projects into the portion of the intermediate space delimited by the contact yoke in a rest position of the resiliently deflectable contact arm.

7. Contact arrangement according to claim 1 wherein the other two contact arms are constructed so as to be resiliently deflectable counter to the deflection direction.

8. Contact arrangement according to claim 1 wherein the resiliently deflectable contact arms are in the form of resilient portions for fixing the contact arrangement in the socket.

9. Contact arrangement according to claim 1 wherein the ends of the contact arms directed counter to the insertion direction are connected to each other so as to form a contact element.

10. Contact arrangement according to claim 1 wherein the spring clip comprises a plurality of resilient arms, at least three of which extend substantially in the insertion direction in the assembly state and are in the form of complementary resilient arms, two of the complementary resilient arms being arranged upstream and downstream of the resiliently deflectable contact arm in the transverse direction in the assembly state, and one of the complementary resilient arms being arranged between the other two contact arms.

11. Contact arrangement according to claim 10 wherein the complementary resilient arms are arranged so as to supplement the polygonally profiled cross-section, which is delimited at least in portions by the contact arms, substantially relative to the socket cross-section.

12. Contact arrangement according to claim 11 wherein there are arranged on the complementary resilient arms pressing portions which are directed away from the spring clip and which are aligned in the assembly state with the contact portions of the contact arms in the transverse direction at least when the contact arrangement is inserted into the socket at least in portions.

13. Contact arrangement according to claim 1 wherein the spring clip is connected electrically conductively to the contact element.

14. Contact arrangement according claim 1 wherein the width of the complementary resilient arms transverse to the insertion direction corresponds to the width of the contact arms in this direction.

15. Contact arrangement according to claim 13 wherein the mutually aligned pressing portions and contact portions form a substantially coherent contact face.

16. Electrical contact arrangement for high pulsed currents and for connection to a polygonal socket comprising:

a contact element which has at least two contact arms which extend substantially in an insertion direction and of which one is constructed so as to be resiliently deflectable relative to the other in a deflection direction which extends perpendicular to the insertion direction, the two contact arms being arranged so as to be spaced apart from each other at least in portions in a deflection direction and there being provided on the contact element at least one other contact arm which extends in the insertion direction and which is arranged so as to be spaced apart from the other two contact arms in a transverse direction which extends perpendicular to the insertion direction and deflection direction, the resiliently deflectable contact arm being movable in the deflection direction at least in portions into the intermediate space between the other two contact arms wherein the contact arrangement comprises a spring clip which can be fitted to the contact element counter to the insertion direction and which can be deformed resiliently in or counter to the deflection direction in the assembly state fitted to the contact element;

wherein the end of the contact arrangement directed in the insertion direction tapers over its extent and forms inclined introduction members which extend in a transverse direction and which are pivoted in relation to the insertion direction.

17. Contact arrangement according to claim 16, wherein one of the inclined introduction members is arranged at the free end of the resiliently deflectable contact arm directed in the insertion direction and the free end projects into the portion of the intermediate space delimited by the contact yoke in a rest position of the resiliently deflectable contact arm.

18. Electrical contact arrangement for high pulsed currents and for connection to a polygonal socket comprising:

a contact element which has at least two contact arms which extend substantially in an insertion direction and of which one is constructed so as to be resiliently deflectable relative to the other in a deflection direction which extends perpendicular to the insertion direction, the two contact arms being arranged so as to be spaced apart from each other at least in portions in a deflection direction and there being provided on the contact element at least one other contact arm which extends in the insertion direction and which is arranged so as to be spaced apart from the other two contact arms in a transverse direction which extends perpendicular to the insertion direction and deflection direction, the resiliently deflectable contact arm being movable in the deflection direction at least in portions into the intermediate space between the other two contact arms wherein the contact arrangement comprises a spring clip which can be fitted to the contact element counter to the insertion direction and which can be deformed resiliently in or counter to the deflection direction in the assembly state fitted to the contact element;

wherein the spring clip comprises a plurality of resilient arms, at least three of which extend substantially in the insertion direction in the assembly state and are in the form of complementary resilient arms, two of the complementary resilient arms being arranged upstream and downstream of the resiliently deflectable contact arm in the transverse direction in the assembly state, and one of the complementary resilient arms being arranged between the other two contact arms.

19. Contact arrangement according to claim 18, wherein the complementary resilient arms are arranged so as to supplement the polygonally profiled cross-section, which is delimited at least in portions by the contact arms, substantially relative to the socket cross-section.

20. Contact arrangement according to claim 19, wherein there are arranged on the complementary resilient arms pressing portions which are directed away from the spring clip and which are aligned in the assembly state with the contact portions of the contact arms in the transverse direction at least when the contact arrangement is inserted into the socket at least in portions.

21. Electrical contact arrangement for high pulsed currents and for connection to a polygonal socket comprising:

a contact element having:

a first contact arm and a second contact arm which extend substantially in an insertion direction and are constructed so as to be resiliently deflectable relative to the other in a deflection direction which extends perpendicular to the insertion direction, the first contact arm and the second contact arm being arranged so as to be spaced apart from each other at least in portions in a deflection direction;

a third contact arm which extends in the insertion direction and which is arranged so as to be spaced apart from the first contact arm and the second contact arm in a transverse direction which extends perpendicular to the insertion direction and deflection direction, the third contact arm being movable in the deflection direction between the first contact arm and the second contact arm; and a spring clip which can be fitted around to the contact element counter to the insertion direction and which can be deformed resiliently in or counter to the deflection direction in the assembly state fitted to the contact element.

* * * * *